US012325455B2

(12) United States Patent
Meier et al.

(10) Patent No.: US 12,325,455 B2
(45) Date of Patent: Jun. 10, 2025

(54) BOGIE FOR A RAIL VEHICLE AND RAIL VEHICLE WITH A BOGIE

(71) Applicant: STADLER RAIL AG, Bussnang (CH)

(72) Inventors: Bruno Meier, Zürich (CH); Alexander Holtgrewe, Bohlingen (DE)

(73) Assignee: Stadler Rail AG, Bussnang (SE)

( * ) Notice: Subject to any disclaimer, the term of this patent is extended or adjusted under 35 U.S.C. 154(b) by 885 days.

(21) Appl. No.: 17/502,336

(22) Filed: Oct. 15, 2021

(65) Prior Publication Data

US 2022/0144322 A1 May 12, 2022

(30) Foreign Application Priority Data

Oct. 27, 2020 (EP) ..... 20204171

(51) Int. Cl.
*B61F 5/52* (2006.01)
*B61F 5/24* (2006.01)
*B61C 9/50* (2006.01)

(52) U.S. Cl.
CPC ..... *B61F 5/52* (2013.01); *B61F 5/24* (2013.01); *B61C 9/50* (2013.01)

(58) Field of Classification Search
CPC ..... B61F 1/00; B61F 1/06; B61F 1/12; B61F 3/00; B61F 3/02; B61F 5/02; B61F 5/08; B61F 5/125; B61F 5/12; B61F 5/24; B61F 5/52; B61C 9/50
USPC ..... 105/199.2
See application file for complete search history.

(56) References Cited

U.S. PATENT DOCUMENTS 3,826,202 A * 7/1974 Russell-French ..... B61F 5/24 105/182.1
4,570,544 A * 2/1986 Smith ..... B61F 5/36 105/224.1
8,671,845 B2 * 3/2014 Xu ..... B61F 5/04 105/197.05
8,720,346 B2 5/2014 Shinmura et al.
(Continued)

FOREIGN PATENT DOCUMENTS

CN 104325991 A * 2/2015 ..... B61F 5/10
DE 20 2008 007 471 U1 12/2008
(Continued)

OTHER PUBLICATIONS

European Search Report, European Patent application No. 20204171.1 (mailed Apr. 16, 2021).

*Primary Examiner* — Zachary L Kuhfuss
*Assistant Examiner* — Heaven R Buffington
(74) *Attorney, Agent, or Firm* — Finch & Maloney PLLC

(57) ABSTRACT

Disclosed is a bogie for a rail vehicle. One embodiment of a rail vehicle includes a bogie frame and at least four wheels arranged at the bogie frame. The bogie frame has a first and second frame parts, each frame part including a longitudinal beam and a cross beam. Each cross beam can be fixedly attached at the first end to the respective longitudinal beam. Each cross beam includes a pin at the second end. The longitudinal beam of the first frame part includes a receptacle for the pin of the second frame part and the longitudinal beam of the second frame part has a receptacle for the pin of the first frame part. The bogie can include one or more at bushing that includes elastomeric material, such as an elastomeric flange bushing, where the bushing is fixed to each cross beam or to the pin of the cross beam.

18 Claims, 9 Drawing Sheets

(56) References Cited

U.S. PATENT DOCUMENTS

Figure 1:
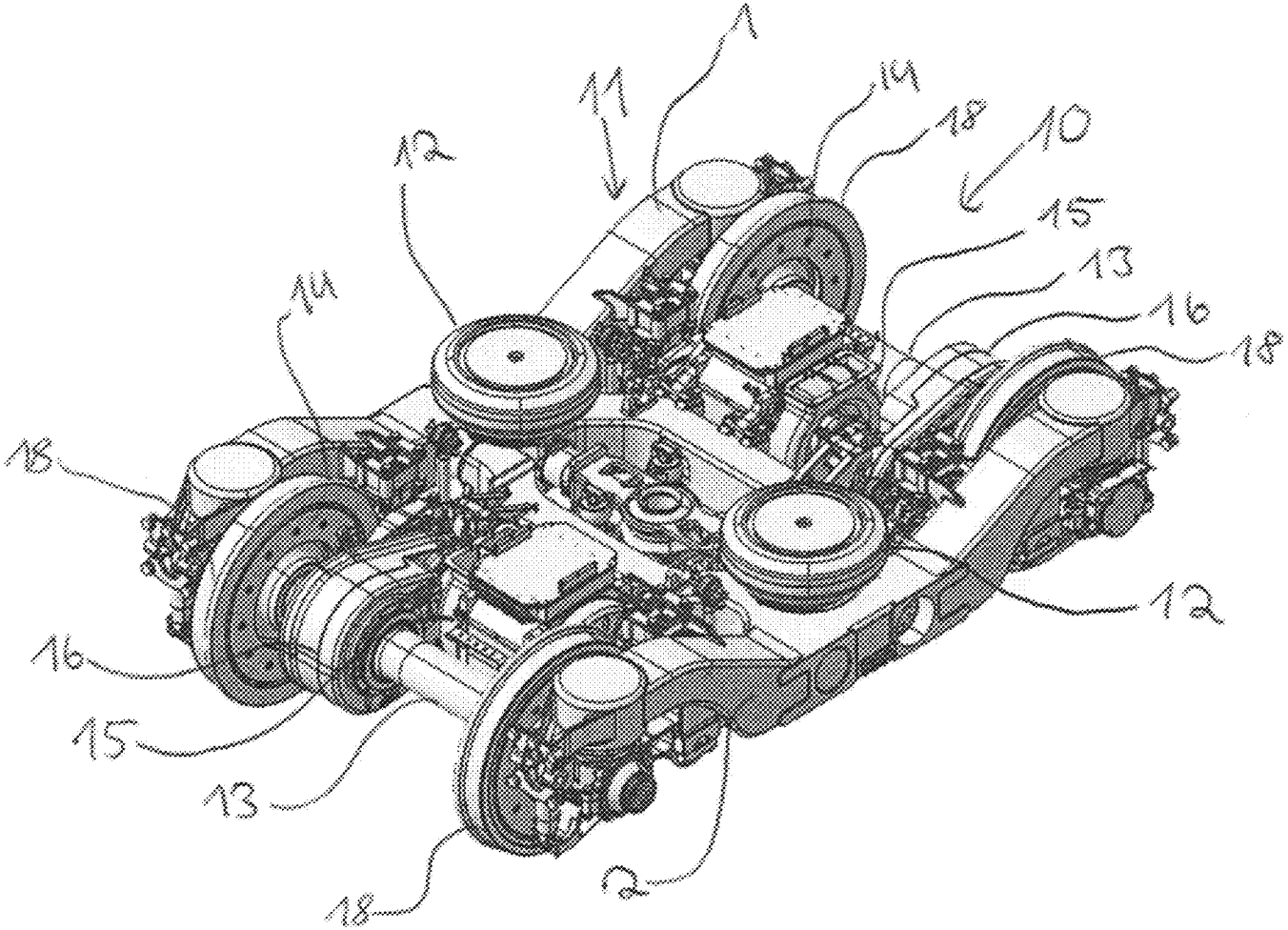

| | | | |
|---|---|---|---|
| 9,469,313 | B2 | 10/2016 | Hagio et al. |
| 2014/0158016 | A1 | 6/2014 | Voisine |

FOREIGN PATENT DOCUMENTS

| | | | | | |
|---|---|---|---|---|---|
| EP | 2 202 127 | A2 | | 6/2010 | |
| EP | 2 537 729 | A1 | | 12/2012 | |
| EP | 2 853 464 | A1 | | 4/2015 | |
| WO | 2009/144319 | A1 | | 12/2009 | |
| WO | WO-2020019581 | A1 | * | 1/2020 | ..... B61C 9/44 |

* cited by examiner

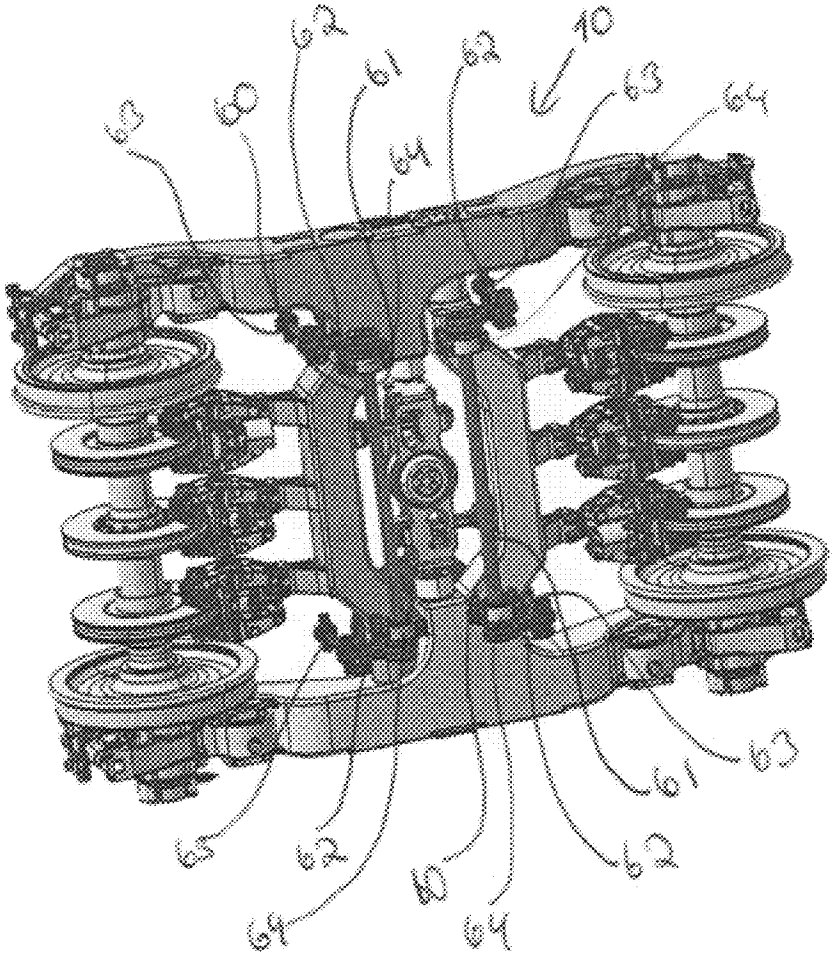
10
34
33
19
29
28
29
19
29
28
29
19
29
28
29

Schnitt A-A

BOGIE FOR A RAIL VEHICLE AND RAIL VEHICLE WITH A BOGIE

The invention relates to a bogie for a rail vehicle and a rail vehicle with a bogie.

It is known that bogies used on uneven rail ways are subjected to a lot of stress. Thus, traditional bogies comprising a one-piece frame use primary suspensions with high flexibilities to counter these effects.

However, these traditional bogies have been adapted to comprise two frame parts to allow for a stiffer primary suspension: From US 2014 158 016 a bogie is known, which comprises two frame parts. This bogie comprises a spherical transom bearing. The drawback of this bogie is that as the two frame parts move relative to each other, the thrust of the movements are translated harshly.

It is the object of the invention to solve the problems of the state of the art and in particular provide a bogie for a rail vehicle and a rail vehicle with a bogie with improved running characteristics, high flexibility against torsion and equal distribution of wheel load.

This is achieved by a bogie for a rail vehicle comprising a bogie frame and at least four wheels, which are arranged at the bogie frame. The bogie frame comprises a length in a longitudinal direction, a width in a cross direction to this longitudinal direction and a height in a height direction, which is perpendicular to both the longitudinal direction and the cross direction. The bogie frame comprises a first and a second frame part, each frame part comprising a longitudinal beam and a cross beam. Each cross beam comprises a first end and a second end. Each cross beam is fixedly attached at the first end to the respective longitudinal beam. Each cross beam comprises a pin at the second end. The longitudinal beam of the first frame part comprises a receptacle for the pin of the second frame part and the longitudinal beam of the second frame part comprises a receptacle for the pin of the first frame part. An at least partially elastomeric element, in particular an elastomeric flange bushing, is fixed to each of the cross beam respectively, in particular to the pin.

The flexible connection of the frame parts soften the thrust of the movements due to the twisting of the tracks and thereby provide a part of the function of the primary springs. Thus, the primary springs do not need to be as flexible and the spring deflection and rebound is reduced, such that the primary spring height can be reduced. Such a bogie provides a great advantage as collisions between the primary spring pot and the structure of the car body are prevented.

The elastomeric element can comprise or consist of natural rubber (NR) and/or a synthetic rubber such as polychloroprene (CR) or nitrile rubber (NBR). The stiffness of the elastomeric element, in particular for an elastomeric flange bushing, can be C radial=200-500 kN/mm, preferably 500 kN/mm C axial=200-500 kN/mm, preferably 250 kN/mm C torsional=0-2000 Nm/°, preferably 1500 Nm/°

C cardanic=0-15000 Nm/°, preferably 12000 Nm/°.

The cross beams and the longitudinal beams may comprise or may be made of cast steel, cast aluminum, nodular graphite cast iron, welded design or carbon fiber.

The cross beam can be hollow section.

The receptacle can be formed as an opening in the longitudinal beam, in particular an opening along an opening axis, wherein the axis is arranged in cross direction. The opening can be a borehole.

Preferably, the cross beams are cranked on one end, in particular cranked at both ends, preferably both in the longitudinal direction, more preferably in opposite directions in the longitudinal direction, most preferably cranked away from each other.

This allows for arranging the pins close to the middle of the length of the bogie, such that the tilt of the pins and the cardanic deformations are reduced and still the bogie frame provides enough space for further components of the bogie.

Preferably, the elastomeric element is essentially cylindrical. Preferably, the elastomeric element can comprise two identical halves, each half having a flange, wherein the halves are connected to form a flange bushing such that the flanges are arranged on the outer sides on opposite sides of the cylindrical body in the middle.

The advantage of this elastomeric element is that the element is stiff both in radial and axial directions, such that high forces are transferrable. Preferably, the identical halves are put on the pin such that the flanges are arranged opposite of each other. The flange on the outside is clamped by a covering element, which covering element is detachably connected to the cross beam and pre-stresses the elastomeric element. Such an element provides an axially and radially stiff and backlash-free connection; the connection also provides low torsion and cardanic stiffness. Preferably, the elastomeric element is connected to the cross beam, in particular the elastomeric element is screwed to the respective cross beam. The elastomeric element may be made of rubber, especially natural rubber.

Preferably, the longitudinal beams are cranked, preferably in the height direction, in particular the middle part of the longitudinal beams is lower than the outer ends.

The receptacle for receiving the cross beams in the respective longitudinal beam may be distanced from the middle of the length of the longitudinal beam by 150-400 mm, in particular 200-300 mm.

This placement of the receptacle has the advantage of providing a well-balanced static wheel load. Additionally, the cardanic deflection of the elastomeric element is smaller the closer the receptacle is to the middle of the length of the longitudinal beam.

Preferably, the bogie comprises at least one, preferably two, secondary springs, in particular pneumatic springs.

The secondary springs may be distributed on the bogie such that the static load on each of the wheels of the bogie is equal. In particular, the pneumatic springs may be distributed in such a way as to compensate for the weight of components such as brakes or motor parts. The springs may be steel springs, rubber springs, hydraulic springs or a combination of two types of springs, such as hydropneumatic springs. The primary springs are of customary design.

Preferably, the bogie comprises at least one, preferably two, anti-roll stabilizer systems.

The bogie may comprise two anti-roll stabilizer systems, one for each cross beam.

Preferably, the anti-roll stabilizer system comprises at least one spring element, in particular a torsion rod.

Preferably, the anti-roll stabilizer system comprises at least one, in particular two, pendulum device, the pendulum device in particular being connected to a lever device and connectable or connected to a car body of a rail vehicle or a bolster. The lever device is fixed on one end to the spring element and to the pendulum device on the other end. The spring element is fastened to the bogie frame in a way that allows for rotational movement of the spring element by at least one, preferably two, connection elements. The lever device can comprise a stop for restricting the upward movement of the lever. In particular, the connection elements are back bearings, in particular rubber bushings. The spring element may be supported by rubber bushings as connection elements. The rubber bushings may comprise two half shells or may be made in a single piece. In particular, the rubber bushing or each half shell may comprise one or more rubber layer. Additionally, the anti-roll stabilizer system may comprise a slide bearing for absorbing torsional movement by the torsion rod. This allows for an easy absorption of torsional movements.

In particular, the distance of the anti-roll stabilizer system, in particular the spring element, from the middle of the length of the longitudinal beam is between 200 mm and 500 mm, preferably 200 mm-300 mm.

Such an anti-roll stabilizer system allows for securing the bogie to the car body in case of lifting the rail car or the traverse.

Preferably, the bogie comprises two anti-roll stabilizer systems, which are arranged symmetrically to a cross middle plane of the bogie, one on each frame part.

This arrangement ensures an equal distribution of the wheel loads per bogie side even during roll of the vehicle.

Preferably, the bogie comprises at least one, preferably four, connection elements for the anti-roll stabilizer systems, in particular two connection elements are arranged on each cross beam.

This allows for an easy attachment of the anti-roll stabilizer system to the bogie frame.

Preferably, the bogie comprises fastening elements, in particular brackets, for fastening further elements to the bogie frame.

This allows for easy attachment of motors, brakes or other components to the bogie frame.

Preferably, the bogie comprises brakes, particularly brakes attached to the longitudinal beams and/or the cross beams.

Brakes attached to the longitudinal beams allow for enough space to attach further components like motors to the cross beams.

The bogie can be a motorized bogie, in particular at least one motor, preferably two motors, is attached to one of, preferably each of, the cross beams.

In particular, the motorized bogie comprises brakes attached to connection elements on the longitudinal beams.

Preferably, the bogie comprises a gear support, wherein the gear support is arranged between the pin and the motor to the cross beam.

This allows for reducing the movement of the coupling between motor and gears.

The bogie can be a carrying bogie. In particular, the carrying bogie comprises brakes attached to the cross beams. The brake discs in this configuration can be attached to the axle. Depending on the brake power needed there can be one to four axle mounted brake discs.

The problem is also solved by a rail vehicle comprising a car body and at least one bogie as previously described.

Preferably, the rail vehicle comprises a bolster.

Preferably, the rail vehicle comprises fasteners, in particular spherical bearings for connecting the rail vehicle to the anti-roll stabilizer system, in particular to the pendulum elements, the fasteners preferably being arranged on the bolster or on the car body.

For maintenance, the rail vehicle including bogie needs to be lifted. The car body is lifted by means of lifting jacks and for lifting the bogie, usually two to four ropes are needed, which are attached to the bogie. The connectors of the rail vehicle allow for lifting up the rail vehicle including the bogie without further means such as ropes.

In particular, the rail vehicle comprises two anti-roll stabilizer systems per bogie, which are arranged symmetrically to a cross middle plane through the bogie and are connected to the car body or to the bolster.

This allows for lifting up the rail vehicle including the bogie without further measures to stabilize the bogie, as the transmission of force is realized through the pendulum devices and the stop at the lever of the anti-roll stabilizer system. A railway vehicle according to the invention can comprise at least one motorized bogie as described before and at least one running bogie as described before wherein the distance between the effective middle points of the secondary springs of the motorized bogie is different from the effective middle points of the secondary springs of the running bogie.

This optimizes the load distribution on all four wheels of each bogie.

Figure 2:
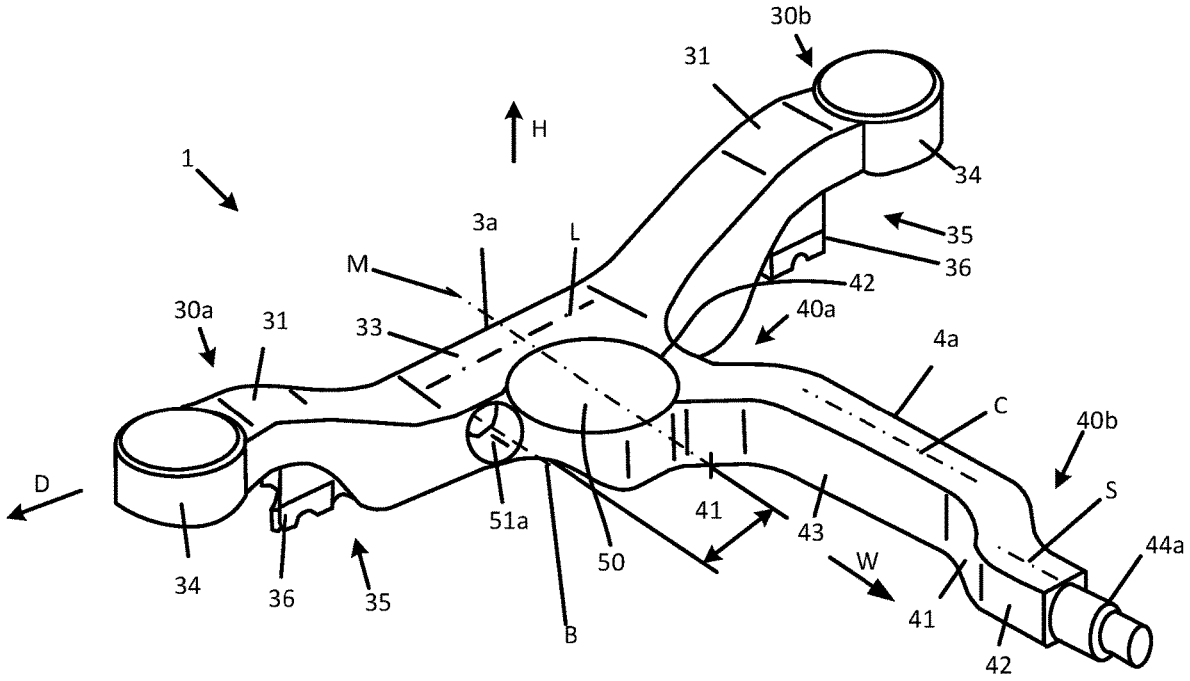
Figure 3:
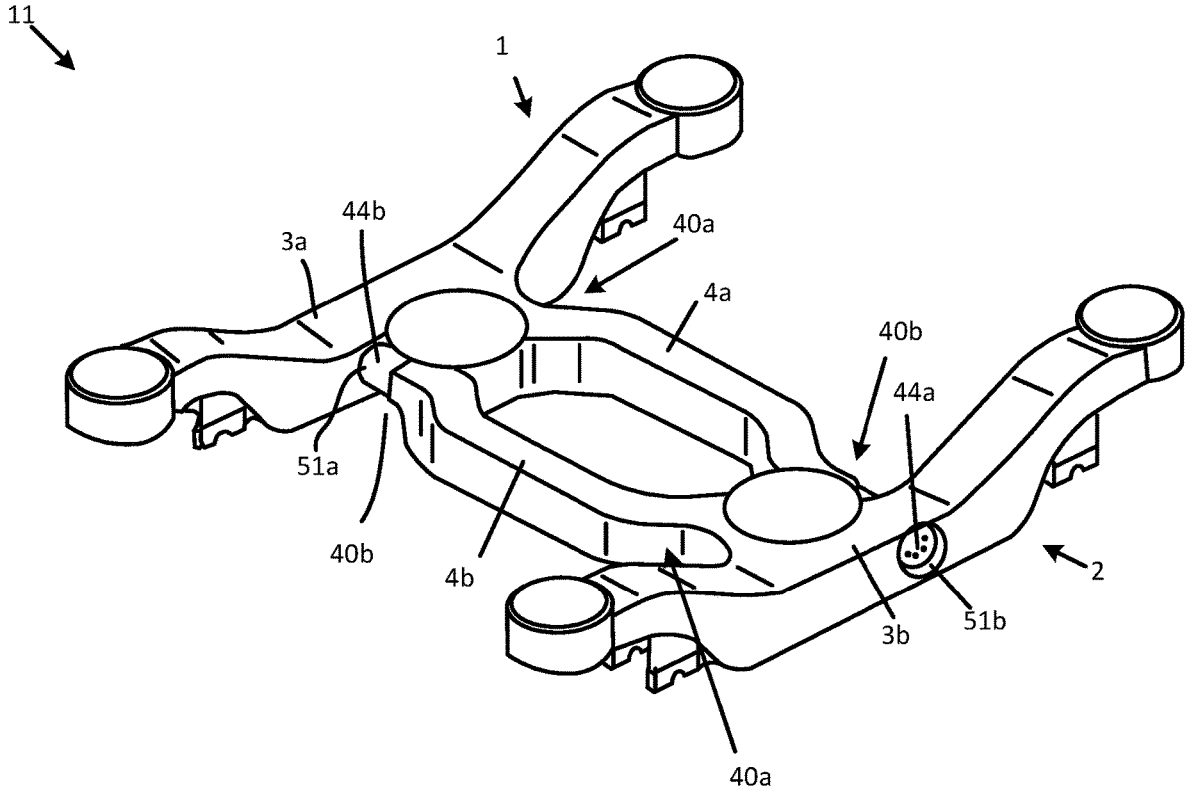
Figure 4A:
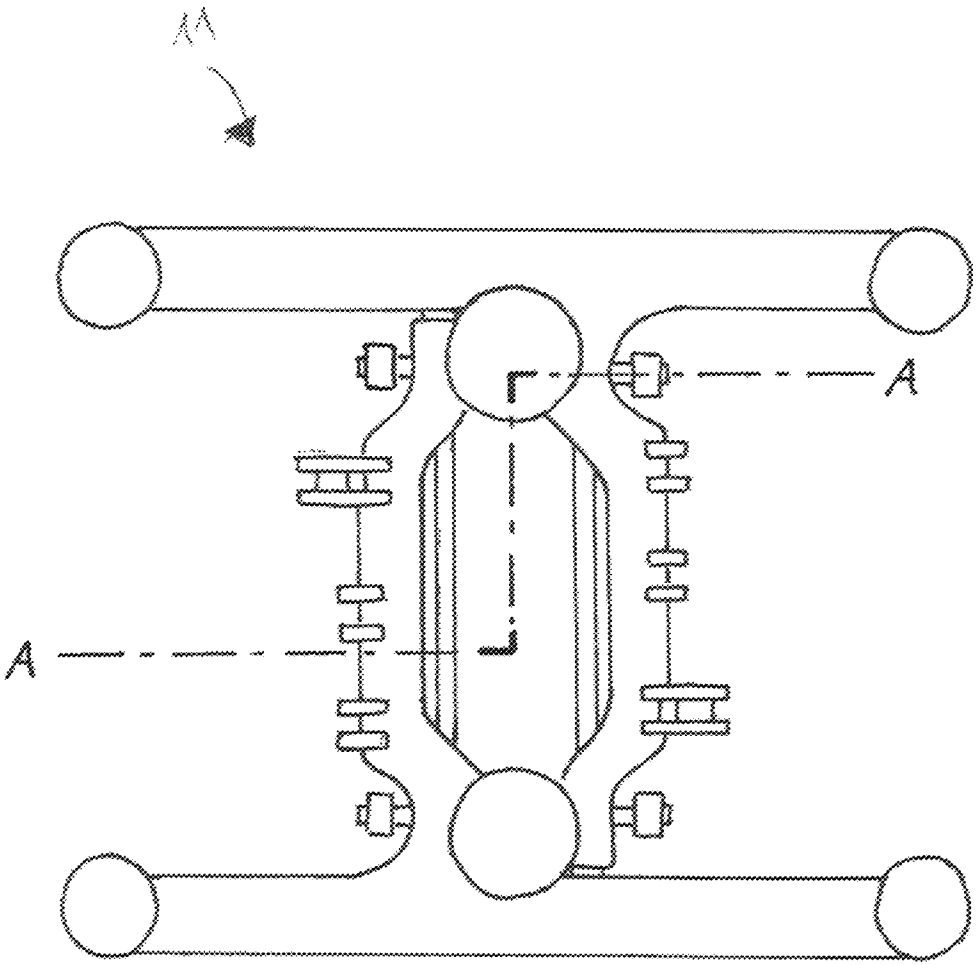

The invention will be described more precisely in the figures. The figures show:

FIG. 1: a perspective view of a motorized bogie,

FIG. 2: a perspective view of a frame part,

FIG. 3: a perspective view of a bogie frame,

FIG. 4: a perspective view of a bogie frame from below with anti-roll stabilizer systems, FIG. 4*a*: a view of the bogie frame of FIG. 4 with the line of a cross section A-A, FIG. 5: a cross section A-A of FIG. 4*a*

Figure 6:
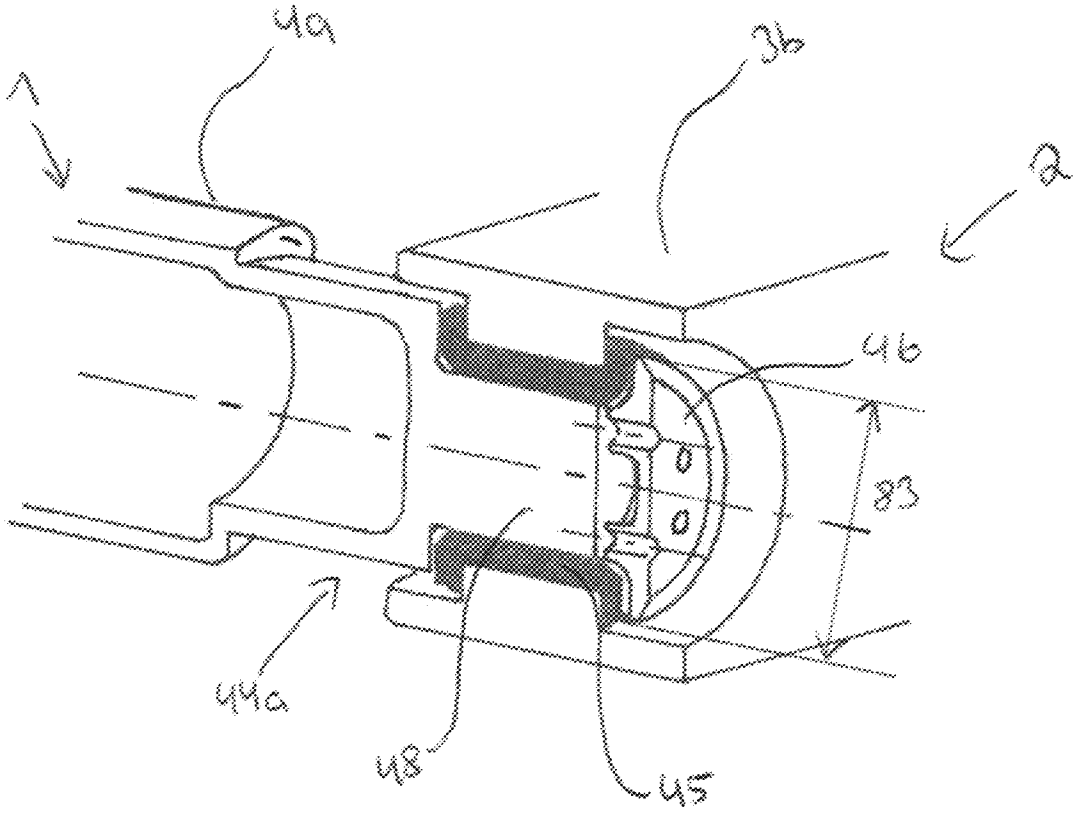
Figure 7:
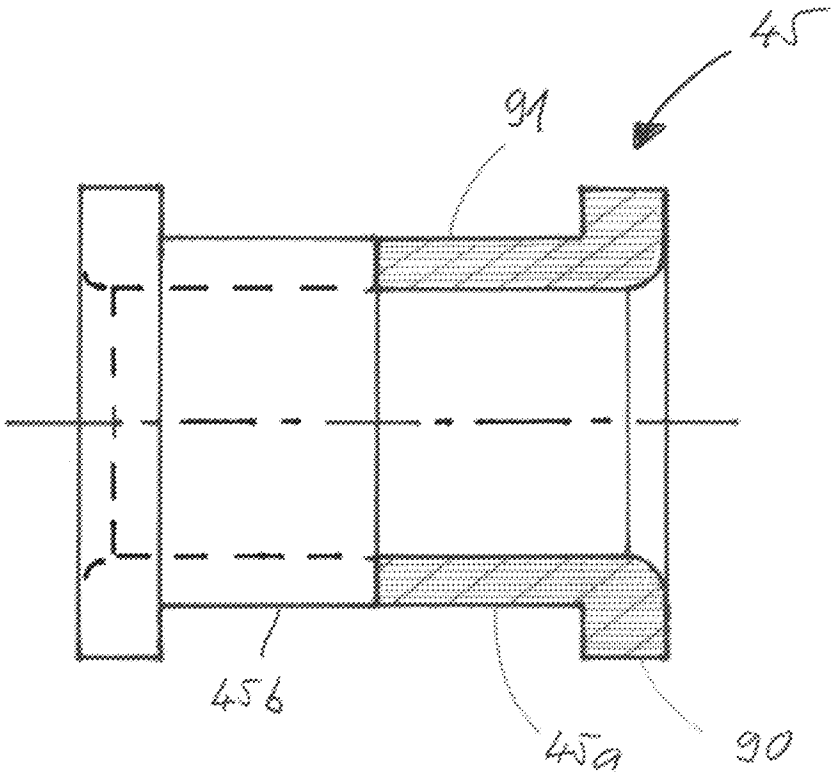
Figure 8:
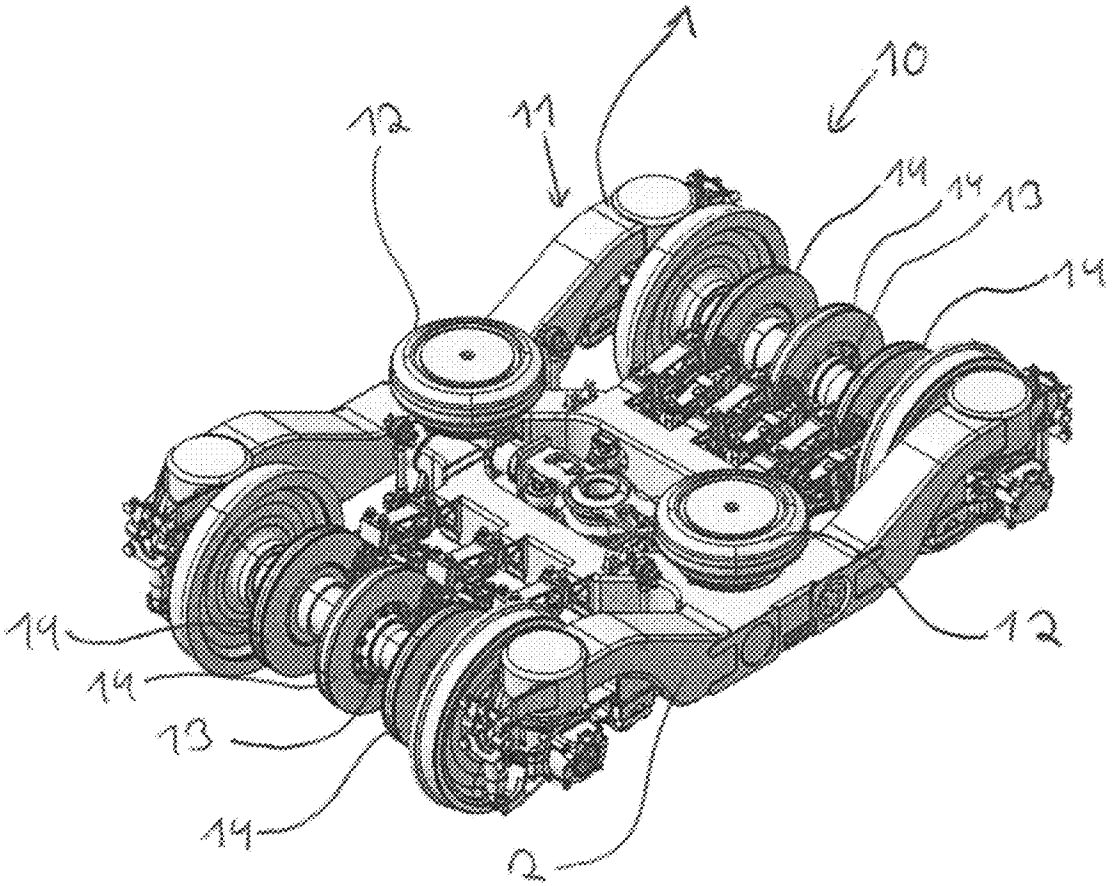

FIG. 6: a cross section of the attachment of the pin of the first frame part to the longitudinal beam of the second frame part, FIG. 7: a side view of a flange bushing, FIG. 8: a perspective view of a trailer bogie.

FIG. 1 shows a perspective view of a bogie 10. In this case the bogie 10 is a motorized bogie. The bogie 10 comprises a bogie frame 11, attached to which there are two secondary springs 12, two wheel sets 13, one brake (not visible) per wheel 18, out of which two brake disks 14 are visible, two motors 15, two gears 16 and two anti-roll stabilizer systems 60 (see FIG. 4). The bogie frame 11 comprises a first frame part 1 and a second frame part 2. The first frame part 1 comprises a longitudinal beam 3*a* (see FIG. 2) and a cross beam 4*a* (see FIG. 2), the second frame part 2 comprises similarly a longitudinal beam 3*b* and a cross beam 4*b* (see FIG. 3). The wheel sets 13 are arranged between the frame parts 1 and 2 and are attached to the ends of the longitudinal beams 3*a* and 3*b*. Each motor 15 is arranged between a wheel set 13 and a cross beam 4*a* or 4*b* and is attached to said cross beam 4*a* or 4*b*. Each gear 16 is connected to a motor 15 and a wheel set 13. Each gear 16 is fixed to the cross beam 4*a*, 4*b* by means of a pendulum device (not visible). Hence, there is a relative movement between motor 15 and gear 16. The relative movement between the motor 15 and the gear 16 is taken over for example by a curved tooth coupling (not visible). Each secondary spring 12 is supported on the first frame part 1 or the second frame part 2, respectively. The positioning of the secondary springs 12 is adapted to the bogie 10 to even out the load on the wheels 18 of the wheel set 13. As the bogie 10 does not comprise one fixed frame but two frame parts 1, 2 which are moveable relative to each other to a certain extent, the load on each wheel 18 of wheels sets 13 can differ and needs to be accounted for. The distance between the effective middle of the secondary springs 12 relative to each other in the cross direction W (see FIG. 2) is therefore adapted to the needs of the bogie 10 and is between 1600 mm and 2000 mm in the present embodiment.

FIG. 2 shows a perspective view of the first frame part 1 of FIG. 1. The frame part 1 comprises a longitudinal beam 3*a* and a cross beam 4*a*. The beams 3*a* and 4*a* have a hollow profile.

The frame part 1 comprises a length in a longitudinal direction D, a width in a cross direction W and a height in a height direction H. The cross direction W is arranged perpendicular to the longitudinal direction D and the height direction H is arranged perpendicular to the longitudinal direction D and the cross direction W.

The cross beam 4*a* comprises a middle part 43, a first end 40*a* and a second end 40*b*. The middle part 43 is formed along a cross axis C, the cross axis C being parallel to the cross direction W.

The cross beam 4*a* is fixedly attached to or is one piece with the longitudinal beam 3*a* by the first end 40*a*. The second end 40*b* comprises a pin 44 for attaching the second end 40*b* to the longitudinal beam 3*b* of the second frame part 2 (see FIG. 3). Each end 40*a* and 40*b* comprises a straight section 42 and a cranked section 41. The straight section 42 is formed along a straight axis S, the straight axis S being arranged parallel to the cross axis C of the middle part 43. The cranked section 41 is cranked in the longitudinal direction D.

The longitudinal beam 3*a* comprises an attachment section 33 and two symmetrically identical arms 35 on opposite sides of the attachment section 33. The arms 35 are arranged in opposite directions relative to a plane through a middle axis M, the middle axis M leading through the middle of the length of the longitudinal beam 3*a* in the cross direction W. The arms 35 comprise ends 30*a* and 30*b*. The ends 30*a* and 30*b* comprise each a rest element 34 and a cranked element 31. The cranked elements 31 are cranked in the height direction H. The attachments section 33 is formed along the longitudinal axis L leading in the longitudinal direction D. The cross beam 4*a* is attached to the attachment section 33. Further, the attachment section 33 comprises a receptacle 51 for the pin 44*b* of the second frame part 2. The receptacle 51 is a bore hole with an bore hole axis B which is arranged parallel to the middle axis M and is distanced to the middle axis M of the longitudinal beam 3*a* at a distance of 200-300 mm. This allows for an equal distribution of the static wheel load.

The frame part 1 comprises a support 50 for the support of a secondary spring 12 (see FIG. 1). The support 50 is arranged between the receptacle 51 and the cross beam 4*a*. The support 50 comprises an essentially round surface on top in height direction H.

FIG. 3 shows a bogie frame 11 in perspective view. The bogie frame 11 comprises two identical frame parts 1 and 2. The frame part 1 has been previously described in FIG. 2. The pin 44*a* of the first frame part 1 is arranged in the receptacle 51*b* of the second frame part 2. The pin 44*b* of the second frame part 2 is arranged in the receptacle 51*a* of the first frame part 1.

FIG. 4 shows a bogie 10 in a perspective view from below. The bogie 10 is a trailer bogie 10 corresponding to the bogie shown in FIG. 8. In this view the two anti-roll stabilizer systems 60 are visible. Each anti-roll stabilizer system 60 comprises a torsional rod 61, two lever devices 62, two pendulum devices 63. Furthermore, the torsional rods 61 are fixed to the cross beams 4*a*, 4*b*. Each lever device 62 is fixed on one end to the torsional rod 61 and to the pendulum device 63 on the other end. The torsional rod 61 is fastened to the bogie frame in a way that allows for rotational movement of the torsional rod 61 by at least one, preferably two, connection elements 64. The lever device 62 comprises a stop (not visible) for restricting the upward movement of the lever device 62. In particular, the connection elements 64 are back bearings, in particular rubber bushings. The torsional rod is supported by rubber bushings. The rubber bushings may comprise two half shells or may be made in a single piece. In particular, the rubber bushing or each half shell may comprise one or more rubber layer. The anti-roll stabilizer system can also be applied to a motorized bogie 10 as shown in FIG. 1.

FIG. 4*a* discloses the bogie frame 11 of FIG. 4 showing the line of a cross section A-A.

Figure 5:
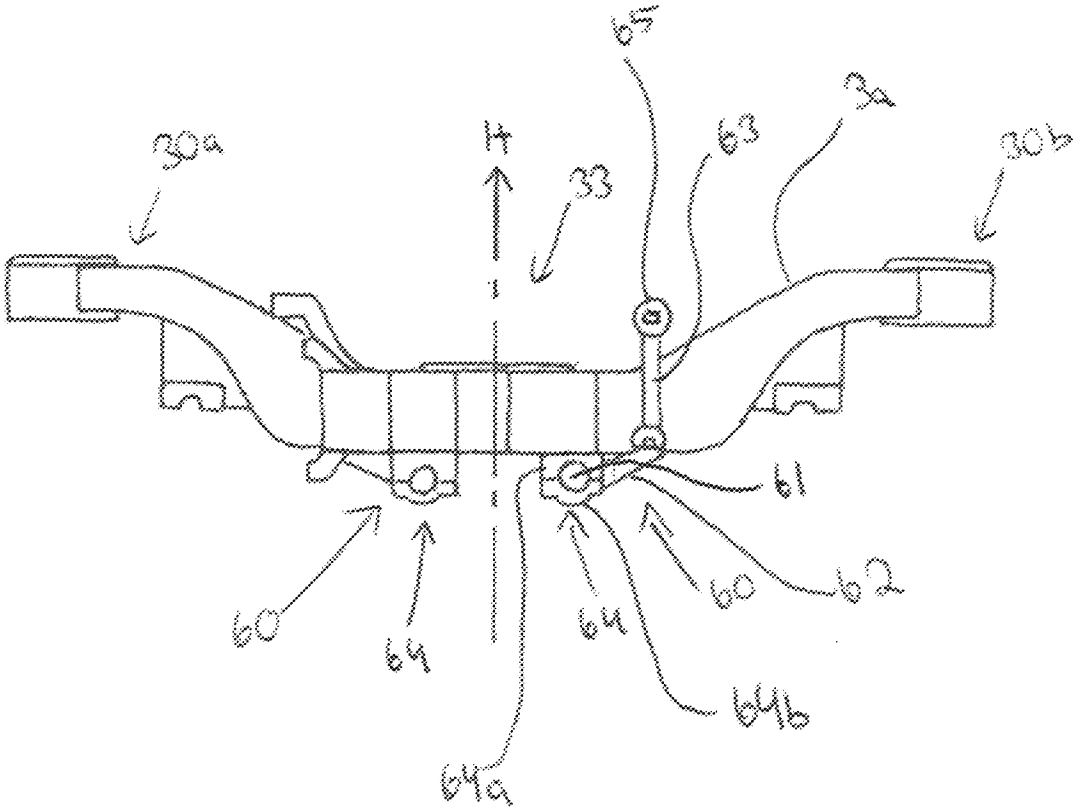

FIG. 5 shows the cross section A-A of FIG. 4*a*. The longitudinal beam 3*a* is cranked on each end 30*a* and 30*b* in the height direction H, such that attachment section 33 is lower than the ends 30*a* and 30*b*. The anti-roll stabilizer systems 60 are attached to the underside of cross beams 4*a* and 4*b* (see FIG. 2) by connection elements 64, here back bearings, in particular rubber bushings. The connection elements 64 comprise two half parts 64*a* and 64*b*, between which the torsion rod 61 is arranged. The pendulum device 63 comprises a connector end 65 for connecting the anti-roll stabilizer system 60 to a connector on a bolster or a car body. Between pendulum device 63 and torsion rod 61 there is lever device 62.

FIG. 6 shows a cross section of the pin 44*a* of the first frame part 1 attached to the longitudinal beam 3*b* of the second frame part 2.

The pin 44*a* comprises a bearing section 48

The bearing section 48 comprises a full profile. Alternatively, a thick walled pipe section is possible.

An elastomeric element 45, here a flange bushing comprising two halves, is attached to the bearing section 48 and held into place by a covering element 46, which is screwed onto the end of the bearing section 48 of the pin 44*a*. The covering element 46 has a larger diameter 83 than the bearing section 48 and therefore pre-stresses the elastomeric element 45.

The pin 44*a* and the elastomeric element 45 rest in the receptacle 51*b* of the second frame part 2. The receptacle 51*b* comprises two ledges to accommodate the elastomeric element 45.

Such a support of the cross beam 4*a* inside the longitudinal beam 3*b* allows for high flexibility against torsional movements and cardanic movements while simultaneously presenting a higher stiffness against radial or axial forces.

FIG. 7 shows the elastomeric element 45 in side view. The elastomeric element 45 comprises two identical halves 45*a* and 45*b*, each half 45*a* and 45*b* comprising a flange 90 and a middle part 91. The middle parts 91 of the elastomeric element 45 are arranged such that they touch on their respective front sides. The elastomeric element 45 comprises an elastomeric material with metal sheet layers for stabilization inside (not shown). The middle part and the flange can comprise one or more layers.

The elastomeric element 45 is made of natural rubber with a stiffness C of:

C radial=500 kN/mm,

C axial=250 kN/mm,

C torsional=1500 Nm/°, torsional angles of up to 5° need to be possible,

C cardanic=12000 Nm/°, cardanic angles of up to 2° need to be possible,

FIG. 8 shows a perspective view of a bogie 10 in form of a trailer bogie. The bogie 10 comprises a bogie frame 11, attached to which there are two secondary springs 12, two wheel sets 13, three brake calipers with brake disks per wheel set 13 and two anti-stabilizer systems 60 (see FIG. 4).

The bogie frame 11 comprises a first frame part 1 and a second frame part 2. The first frame part 1 comprises a longitudinal beam 3*a* (see FIG. 2) and a cross beam 4*a* (see FIG. 2), the second frame part 2 comprises similarly a longitudinal beam 3*b* and a cross beam 4*b* (see FIG. 3). The wheel sets 13 are arranged between the frame parts 1 and 2 and are attached to the ends of the longitudinal beams 3*a* and 3*b*. Each secondary spring 12 is supported on the first frame part 1 or the second frame part 2, respectively. The positioning of the secondary springs 12 is adapted to the bogie 10 to even out the load on the wheels of the wheel set 13. As the bogie 10 does not comprise one fixed frame but two frame parts 1, 2 which are moveable relative to each other to a certain extent, the load on each wheel of wheels sets 13 can differ and needs to be accounted for. The distance between the effective middle of the secondary springs 12 relative to each other in the cross direction W (see FIG. 2) is therefore adapted to the needs of the bogie 10 and is between 1600 mm and 2000 mm in the present embodiment. In particular the distance between the effective middle of the secondary springs 12 of the trailer bogie 10 can differ from the distance between the effective middle of the secondary springs of a motorized bogie 10 according to FIG. 1.

The invention claimed is:

1. A bogie for a rail vehicle, the bogie comprising:

a bogie frame and at least four wheels which are arranged at the bogie frame, wherein the bogie frame comprises a length in a longitudinal direction (D), a width in a cross direction (C) to this longitudinal direction (D), and a height in a height direction (H) which is perpendicular to both the longitudinal direction (D) and the cross direction (C);

wherein the bogie frame comprises first and second frame parts each comprising a longitudinal beam and a cross beam, the cross beam comprising a first end and a second end, the cross beam fixedly attached at the first end to the respective longitudinal beam, and the cross beam comprising a pin at the second end;

wherein the longitudinal beam of the first frame part comprises a receptacle for the pin of the second frame part and the longitudinal beam of the second frame part comprises a receptacle for the pin of the first frame part; and an at least partially elastomeric element fixed to each cross beam, wherein the bogie further comprises two anti-roll stabilizer systems, each of the two anti-roll stabilizer systems arranged symmetrically to a cross-middle plane of the bogie with one of the two anti-roll stabilizer systems on each of the first and second frame parts.

2. The bogie according to claim 1, wherein the at least partially elastomeric element is an elastomeric flange bushing.

3. The bogie according to claim 1, wherein the at least partially elastomeric element is fixed to the pin of each cross beam.

4. The bogie according to claim 1, wherein each cross beam is cranked on at least one end in the longitudinal direction (D).

5. The bogie according to claim 4, wherein each longitudinal beam is cranked in the height direction (H) so that a middle part of the longitudinal beam is lower than the first and second ends.

6. The bogie according to claim 1, wherein the at least partially elastomeric element is essentially cylindrical.

7. The bogie according to claim 6, wherein the elastomeric element comprises two identical halves, each half having a flange, wherein the identical halves are connected to define a flange bushing.

8. The bogie according to claim 1, wherein the receptacle for receiving the cross beam of the respective longitudinal beam is distanced from a middle of a length of the longitudinal beam by 150-400 mm.

9. The bogie according to claim 8, wherein the receptacle is distanced from the middle by 200-300 mm.

10. The bogie according to claim 1, wherein the two anti-roll stabilizer systems comprise at least one spring element, connectable or connected to connection elements.

11. The bogie according to claim 10, wherein the at least one spring element comprises a torsion rod.

12. The bogie according to claim 11, wherein the two anti-roll stabilizer systems comprise at least one connection element and a spring element, the at least one connection element arranged on the cross beam such that the spring element is connectable or connected to the at least one connection element.

13. The bogie according to claim 10, wherein the two anti-roll stabilizer systems comprise at least one pendulum device, the pendulum device being connectable or connected to the bogie via a lever device and connectable to a car body of a rail vehicle or a bolster.

14. The bogie according to claim 1, wherein the bogie comprises brakes attached to the one or more of the longitudinal beams and/or to one or more of the cross beams.

15. The bogie according to claim 1, further comprising at least one motor attached to one of the cross beams.

16. The bogie according to claim 15, wherein the bogie comprises a gear support arranged between the pin and an attachment of the at least one motor.

17. The bogie according to claim 1, wherein the bogie is a carrying bogie.

18. A rail vehicle comprising:

at least one bogie according claim 1;

a car body attached to the at least one bogie.

* * * * *